US011387551B2

(12) United States Patent
Lv et al.

(10) Patent No.: US 11,387,551 B2
(45) Date of Patent: Jul. 12, 2022

(54) TRIPLE-RESONANT NULL FREQUENCY SCANNING ANTENNA

(71) Applicant: NANJING UNIVERSITY OF POSTS AND TELECOMMUNICATIONS, Nanjing (CN)

(72) Inventors: Wenjun Lv, Nanjing (CN); Sijie Li, Nanjing (CN); Yun Shao, Nanjing (CN); Jianyuan Wang, Nanjing (CN); Han Wu, Nanjing (CN); Zhibin Zhao, Nanjing (CN); Zhifang Wu, Nanjing (CN); Xiaohui Li, Nanjing (CN); Hongbo Zhu, Nanjing (CN); Xiaofei Li, Nanjing (CN)

(73) Assignee: NANJING UNIVERSITY OF POSTS AND TELECOMMUNICATIONS, Nanjing (CN)

( * ) Notice: Subject to any disclaimer, the term of this patent is extended or adjusted under 35 U.S.C. 154(b) by 0 days.

(21) Appl. No.: 17/053,240

(22) PCT Filed: Jun. 16, 2020

(86) PCT No.: PCT/CN2020/096332

§ 371 (c)(1),
(2) Date: Nov. 5, 2020

(87) PCT Pub. No.: WO2021/031669

PCT Pub. Date: Feb. 25, 2021

(65) Prior Publication Data

US 2021/0367334 A1 Nov. 25, 2021

(30) Foreign Application Priority Data

Aug. 21, 2019 (CN) ..... 201910773549.7

(51) Int. Cl.
*H01Q 3/22* (2006.01)
*H01Q 9/04* (2006.01)
*H01Q 9/28* (2006.01)

(52) U.S. Cl.
CPC ..... *H01Q 3/22* (2013.01); *H01Q 9/0421* (2013.01); *H01Q 9/285* (2013.01)

(58) Field of Classification Search
CPC ..... H01Q 3/22; H01Q 9/0421; H01Q 9/285; H01Q 1/36; H01Q 9/0442; H01Q 5/364;
(Continued)

(56) References Cited

U.S. PATENT DOCUMENTS

2021/0367349 A1* 11/2021 Lv ..... H01Q 15/22

FOREIGN PATENT DOCUMENTS

CN 109494458 A * 3/2019

* cited by examiner

*Primary Examiner* — Andrea Lindgren Baltzell
*Assistant Examiner* — Jesus E Cano
(74) *Attorney, Agent, or Firm* — CBM Patent Consulting, LLC

(57) ABSTRACT

The present invention discloses a triple-resonant null frequency scanning antenna, which belongs to the technical fields of the Internet of Things and microwave. The triple-resonant null frequency scanning antenna comprises a circular sector magnetic dipole arranged on a medium substrate, and rectangular notches are symmetrically arranged on a sector patch of the circular sector magnetic dipole. The circular sector magnetic dipole is fixed on the medium substrate by a second shorting pin and third shorting pins, an flared angle of the circular sector magnetic dipole is a first central angle, and two third shorting pins are present and are symmetrically arranged on both sides of the angular bisector of the first central angle.

8 Claims, 3 Drawing Sheets

(58) Field of Classification Search
CPC .. H01Q 1/12; H01Q 1/38; H01Q 1/50; H01Q 5/10; H01Q 5/28; H01Q 5/314; H01Q 5/321; H01Q 9/16
See application file for complete search history.

TRIPLE-RESONANT NULL FREQUENCY SCANNING ANTENNA

TECHNICAL FIELD

The present invention belongs to the technical fields of the Internet of Things and microwave, and particularly relates to a triple-resonant null frequency scanning antenna.

BACKGROUND

In recent years, with the continuous development of wireless communication technology, the radio direction finding technology is also constantly developing. Radio direction finding utilizes the directional characteristic of a direction-finding antenna to determine the directions of incoming waves according to the difference in amplitudes of received signals of the incoming waves from different directions. Passive location to which it belongs directly uses electromagnetic waves transmitted by a target to determine the positional information of the target. However, the frequency range of interference signals is constantly broadening at present, which poses higher requirement for the miniaturization of direction-finding antennas.

Microstrip patch antennas are antennas that are most widely used in microwave systems. Except that array antennas can realize wide beam scanning, common microstrip patch antennas do not have the null frequency scanning functionality.

SUMMARY

Objective: the objective of the present invention is to provide a triple-resonant null frequency scanning antenna with a frequency scanning width of up to 100°, which is characterized by small size, high gain, simple structure, low cost, etc., and is beneficial to planar design and miniaturized application.

Technical solution: in order to realize the aforementioned objective, the present invention provides the following technical solutions:

Disclosed is a triple-resonant null frequency scanning antenna, wherein the triple-resonant null frequency scanning antenna comprises a circular sector magnetic dipole arranged on a medium substrate, and rectangular notches are symmetrically arranged on a sector patch of the circular sector magnetic dipole; the circular sector magnetic dipole is fixed on the medium substrate by a second shorting pin and third shorting pins, an flared angle of the circular sector magnetic dipole is a first central angle, and two third shorting pins are present and are symmetrically arranged on two sides of the angular bisector of the first central angle, and three resonance points are formed through the cooperation between the circular sector magnetic dipole, the shorting pins and the notches.

Further, the circular sector magnetic dipole is connected to a parasitic sector magnetic dipole by a vertical shorting wall, and the sum of the first central angle and a second central angle is 360°.

Further, the first central angle is greater than 180° and less than 350°, and an flared angle of the parasitic sector magnetic dipole is the second central angle, which is greater than 10° and less than 180°.

Further, both the circular sector magnetic dipole and the parasitic sector magnetic dipole are of non-closed structures, and the circular sector magnetic dipole is as high as the parasitic sector magnetic dipole.

Further, the parasitic sector magnetic dipole is fixed on the medium substrate by a first shorting pin.

Further, the rectangular notches have a length of 10 mm to 30 mm, a width of 5 mm to 10 mm and a rotation angle of 30° to 90°.

Further, a feed element is arranged on the circular sector magnetic dipole, and the feed element is a coaxial line.

Further, the distance from the circular sector magnetic dipole to the medium substrate is 3 mm to 7 mm, and the edge length of the circular sector magnetic dipole is 2 to 5 times a wavelength.

Further, the permittivity of the medium substrate is 1 to 20.

Advantages: compared with the prior art, the triple-resonant null frequency scanning antenna of the present invention is able to form three resonances points by a combination of the circular sector magnetic dipole and the shorting pins and by arranging the notches, and by utilizing the frequency dispersion of radiation nulls, wide-angle scanning null frequency functionality can be realized; and the antenna is small in size, simple in structure and low in profile, is convenient to manufacture and implement, and can realize wide-angle scanning of frequency without additional complex phase-shift power division network, thus having a broad application prospect in various wireless sensing systems and radio-frequency identification systems of the Internet of Things.

Figure 1:
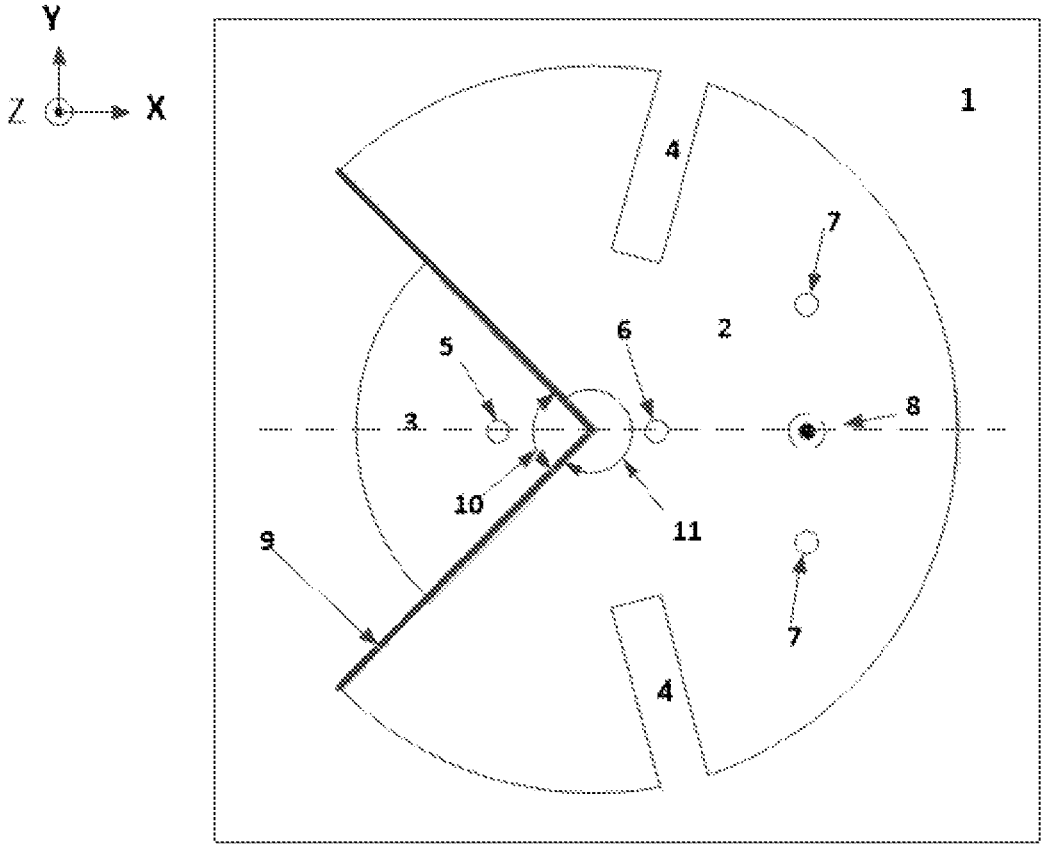
FIG. 1 shows a schematic diagram of antenna's front structure and reference coordinate.

Numerals in the drawings: 1. medium substrate; 2. circular sector magnetic dipole; 3. parasitic sector magnetic dipole; 4. rectangular notches; 5. first shorting pin; 6. second shorting pin; 7. third shorting pins; 8. feed element; 9. shorting wall; 10. second central angle; 11. first central angle.

DETAILED DESCRIPTION

In order to better understand the content of the patent for invention, the technical solution of the present invention will be further illustrated with reference to the drawings and specific embodiments.

Figure 2:
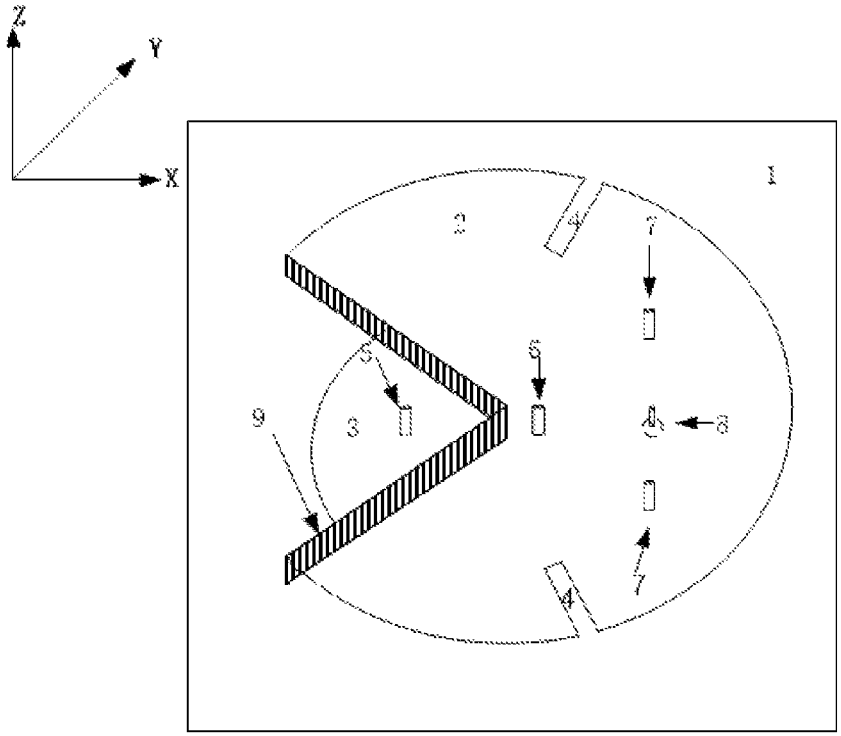
FIG. 2 shows a three-dimensional schematic diagram of the antenna and a schematic diagram of a reference coordinate.

As shown in FIG. 1 and FIG. 2, a triple-resonant null frequency scanning antenna comprises a circular sector magnetic dipole 2 and a parasitic sector magnetic dipole 3 arranged on a medium substrate 1, two rectangular notches 4 are symmetrically arranged on the circular sector magnetic dipole 2, and triple-resonant null frequency scanning antenna unitizes a combination of the circular sector magnetic dipole 2 and shorting pins and the arrangement of rectangular silts 4. The shorting pins comprise a first shorting pin 5, a second shorting pin 6, and third shorting pins 7.

The circular sector magnetic dipole 2 is of a non-closed structure and comprises a first sector patch, the medium substrate 1, and a vertical shorting wall 9 connecting straight edges of the first sector patch and the medium substrate 1. The two rectangular notchs 4 are symmetrically arranged on the sector patch of the circular sector magnetic dipole 2, and the sector patch is fixed on the medium substrate 1 by the second shorting pin 6 and the third shorting pins 7, wherein two third shorting pins 7 are present and are symmetrically arranged on two sides of the angular bisector of the first central angle 11.

The parasitic sector magnetic dipole 3 is of a non-closed structure and comprises a second sector patch, the medium substrate 1, and the vertical shorting wall 9 connecting the straight edges of the second sector patch and the medium substrate 1, wherein the second sector patch is connected to the medium substrate 1 by the first shorting pin 5.

The circular sector magnetic dipole 2 is as high as the parasitic sector magnetic dipole 3, and the circular sector magnetic dipole 2 is provided with a feed structure. The radii of the circular sector magnetic dipole 2 and the parasitic sector magnetic dipole 3 can be changed.

The length, width and rotation angle of each rectangular notch 4 can be changed within a length range from 10 mm to 30 mm, a width range from 5 mm to 10 mm and a rotation angle range from 30° to 90°, respectively.

The feed element 8 is a coaxial line. The distance from the circular sector magnetic dipole 2 to the medium substrate 1 can be changed within a range from 3 mm to 7 mm. The permittivity of the medium substrate 1 is 1 to 20.

The sum of the first central angle 11 and a second central angle 10 is 360°. An flared angle of the circular sector magnetic dipole 2 is the first central angle 11, and the first central angle 11 is greater than 180° and less than 350°. A flared angle of the parasitic sector magnetic dipole 3 is the second central angle 10, and the second central angle 10 is greater than 10° and less than 180®. The edge length of the circular sector magnetic dipole 2 is 2 to 5 times a wavelength.

Air medium is adopted in the present embodiment. The length of the medium substrate 1 is 150 mm. The spacing between the two sector magnetic dipoles and the medium substrate 1 is 5 mm. The radius of the circular sector magnetic dipole 2 is 60 mm, and the radius of the parasitic sector magnetic dipole 3 is 48 mm. The degree of the first central angle 11 is 240°, and the degree of the second central angle 10 is 120°. The two rectangular notches 4 on the circular sector magnetic dipole are 25 mm in length and 7.4 mm in width. A feed point is 40 mm away from the circle center on the central axis of the structure of the circular sector magnetic dipole 2. The included angles between both shorting pins 7 and the x axis are 40°. Each characteristic of the antenna is simulated by simulation with HFSS software.

Figure 3:
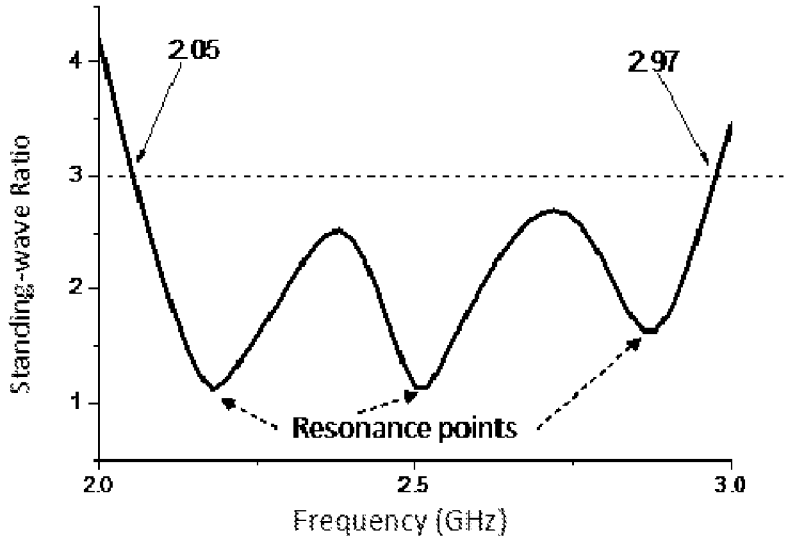
FIG. 3 shows the standing-wave ratio characteristic of the antenna simulated by HFSS software.

FIG. 3 shows the voltage standing-wave ratio characteristic of the antenna calculated by HFSS software, and the standing-wave ratio of the antenna is less than 3 within a frequency band from 2.05 GHz to 2.97 GHz.

Figure 4:
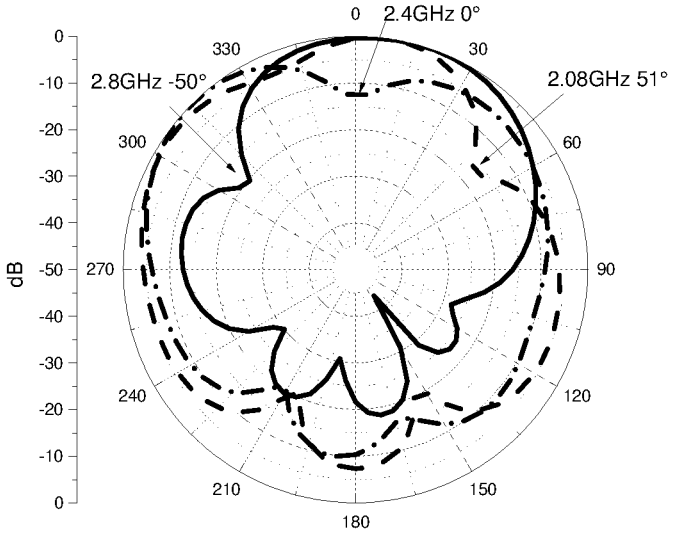
FIG. 4 shows a radiation pattern of the antenna simulated by HFSS software.

FIG. 4 shows a radiation pattern of the antenna calculated by HFSS software, wherein the dotted line denotes a pattern at the frequency of 2.08 GHz, and a null appears at an elevation angle of 51°; the dot-dash line denotes a pattern at the frequency of 2.4 GHz, and a null appears at the zenith (an elevation angle of 0°); and the solid line denotes a pattern at the frequency of 2.8 GHz, and a null appears at an elevation angle of −50°. Therefore, within the frequency band range from 2.08 GHz to 2.80 GHz, the range of null scanning angle can reach more than 100°.

Those skilled in the art can understand that, unless otherwise defined, all the terms (including technical terms and scientific terms) used herein have the same meanings as those generally understood by those of ordinary skill in the art to which the present invention belongs. It should also be understood that terms, such as those defined in a general dictionary, should be construed to have meanings consistent with those in the context of the prior art, and will not be explained in idealized or overly formal meanings, unless defined as herein.

What is described above is only a specific embodiment of the present invention, and the protection scope of the present invention is not limited to this. Any transformation or substitution which can be understood or thought of by those familiar with this technology within the technical scope disclosed by the present invention shall fall within the coverage of the present invention. Therefore, the protection scope of the present invention shall be subject to the protection scope of the claims.

What is claimed is:

1. A triple-resonant null frequency scanning antenna, wherein the triple-resonant null frequency scanning antenna comprises a circular sector magnetic dipole (2) arranged on a medium substrate (1), and rectangular notches (4) are symmetrically arranged on a sector patch of the circular sector magnetic dipole (2); the circular sector magnetic dipole (2) is fixed on the medium substrate (1) by a second shorting pin (6) and third shorting pins (7), an flared angle of the circular sector magnetic dipole (2) is a first central angle (11), and two third shorting pins (7) are present and are symmetrically arranged on two sides of the angular bisector of the first central angle (11); three resonance points are formed through the cooperation between the circular sector magnetic dipole, the shorting pins and the notches; and the circular sector magnetic dipole (2) is connected to a parasitic sector magnetic dipole (3) by a vertical shorting wall (9), and the parasitic sector magnetic dipole (3) is fixed on the medium substrate (1) by a first shorting pin (5).

2. The triple-resonant null frequency scanning antenna according to claim 1, wherein an flared angle of the parasitic sector magnetic dipole (3) is a second central angle (10), and the sum of the first central angle (11) and the second central angle (10) is 360°.

3. The triple-resonant null frequency scanning antenna according to claim 2, wherein the first central angle (11) is greater than 180° and less than 350°, and the second central angle (10) is greater than 10° and less than 180°.

4. The triple-resonant null frequency scanning antenna according to claim 2, wherein both the circular sector magnetic dipole (2) and the parasitic sector magnetic dipole (3) are of non-closed structures, and the circular sector magnetic dipole (2) is mounted on the medium substrate opposite the parasitic sector magnetic dipole (3).

5. The triple-resonant null frequency scanning antenna according to claim 1, wherein the rectangular notches (4) have a length of 10 mm to 30 mm, a width of 5 mm to 10 mm and a rotation angle of 30° to 90°.

6. The triple-resonant null frequency scanning antenna according to claim 1, wherein a feed element (8) is arranged on the circular sector magnetic dipole (2), and the feed element (8) is a coaxial line.

7. The triple-resonant null frequency scanning antenna according to claim 4, wherein the distance from the circular sector magnetic dipole (2) to the medium substrate (1) is 3 mm to 7 mm, and the edge length of the circular sector magnetic dipole (2) is 2 to 5 times a wavelength.

8. The triple-resonant null frequency scanning antenna according to claim 1, wherein the permittivity of the medium substrate (1) is 1 to 20.

* * * * *